US010473426B2

(12) United States Patent
Tedder et al.

(10) Patent No.: US 10,473,426 B2
(45) Date of Patent: Nov. 12, 2019

(54) CONVERTIBLE HOLSTER

(71) Applicant: Tedder Industries, LLC, Post Falls, ID (US)

(72) Inventors: Thomas Tedder, Post Falls, ID (US); Jacob Shearer, Post Falls, ID (US); Silas Van Natter, Post Falls, ID (US); Taylor Vold, Valleyford, WA (US)

(73) Assignee: TEDDER INDUSTRIES, LLC, Post Falls, ID (US)

( * ) Notice: Subject to any disclaimer, the term of this patent is extended or adjusted under 35 U.S.C. 154(b) by 33 days.

(21) Appl. No.: 15/817,162

(22) Filed: Nov. 17, 2017

(65) Prior Publication Data

US 2018/0142988 A1 May 24, 2018

Related U.S. Application Data

(60) Provisional application No. 62/461,700, filed on Feb. 21, 2017, provisional application No. 62/424,219, filed on Nov. 18, 2016.

(51) Int. Cl.

| | |
|---|---|
| ***F41C 33/02*** | (2006.01) |
| ***A45F 5/02*** | (2006.01) |
| ***F41C 33/04*** | (2006.01) |

(52) U.S. Cl.

CPC ..... *F41C 33/0236* (2013.01); *F41C 33/041* (2013.01); *A45F 5/021* (2013.01); *A45F 2200/0591* (2013.01); *F41C 33/048* (2013.01)

(58) Field of Classification Search

CPC ..... F41C 33/0236; F41C 33/0245; F41C 33/0209; F41C 33/0218; F41C 33/0227; F41C 33/048; F41C 33/02; F41C 3/0254; Y10S 224/911; Y10S 224/912; A45F 2200/0591

USPC ..... 224/575, 587

See application file for complete search history.

(56) References Cited

U.S. PATENT DOCUMENTS

| | | | | | |
|---|---|---|---|---|---|
| 5,467,909 | A * | 11/1995 | Resca | F41C 33/0245 | 224/193 |
| 6,402,001 | B1 * | 6/2002 | Madarang | F41C 33/008 | 224/191 |
| 6,616,020 | B1 * | 9/2003 | Spielberger | F41C 33/0245 | 224/183 |
| 7,434,712 | B2 * | 10/2008 | Cook | F41C 33/0209 | 224/193 |
| 8,302,827 | B1 * | 11/2012 | Cole | F41C 9/02 | 224/243 |
| 8,684,242 | B2 * | 4/2014 | Pomeroy | F41C 33/0209 | 224/191 |
| 8,870,042 | B2 * | 10/2014 | Clifton | A45F 5/02 | 224/198 |
| 9,581,413 | B2 * | 2/2017 | Massaro, Jr. | F41C 33/04 | |

(Continued)

*Primary Examiner* — Adam J Waggenspack
(74) *Attorney, Agent, or Firm* — Timberline Patent Law Group

(57) ABSTRACT

Representative implementations of devices and techniques provide a convertible implement holster (such as a handgun holster, for example) comprising a multi-part shell. The convertible holster system allows a user to convert a holster into multiple configurations, including a full-shell configuration and a half-shell configuration, for various carry options. The holster may be interchangeably coupled to various attachment means (e.g., paddle, backer, modular coupler, strap, belt, etc.) for wearing or carrying the holster in the multiple configurations.

16 Claims, 12 Drawing Sheets

(56) References Cited

U.S. PATENT DOCUMENTS

| | | | | |
|---|---|---|---|---|
| 10,030,934 | B2 * | 7/2018 | Metayer | F41C 33/0209 |
| 2015/0233671 | A1 * | 8/2015 | Schmadeka | F41C 33/0209<br>224/587 |
| 2016/0025452 | A1 * | 1/2016 | Crye | F41C 33/048<br>224/587 |

* cited by examiner

CONVERTIBLE HOLSTER

PRIORITY CLAIM AND CROSS-REFERENCE TO RELATED APPLICATION

This application claims the benefit under 35 U.S.C. § 119(e)(1) of U.S. Provisional Application No. 62/424,219, filed Nov. 18, 2016, and U.S. Provisional Application No. 62/461,700, filed Feb. 21, 2017, both of which are hereby incorporated by reference in their entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and re-holstered, usually with the same hand. However, the holster should also be versatile enough to be comfortably carried by the user, such as when it is worn on the person of the user for an extended length of time.

In many circumstances it can be desirable to have more than one holster configuration for a handgun or other implement. For example, at different times it may be desirable to have one holster configured for outside-the-waistband (OWB) carry, another holster configured for inside-the-waistband (IWB) carry, still another holster for shoulder carry, an additional holster for ankle carry, and so forth, often for the same handgun. The desire for multiple holster configurations can be further compounded for multiple handguns (or implements).

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Representative implementations of devices and techniques provide a convertible or adaptable implement holster (such as a handgun holster, for example) comprising a multi-part shell. The convertible holster system allows a user to convert a holster into multiple configurations for various carry options. The holster may be interchangeably coupled to various attachment means (paddle, backer, modular coupler, strap, belt, etc.) for wearing or carrying the holster in the multiple configurations.

The convertible holster system allows for a user to have either a full-shell holster or a half-shell holster on demand. For example, the user may convert a holster from a first configuration as a full-shell holster to a second configuration as a half-shell holster, or vice versa, in the field as desired, with minimal effort. For instance, the first full-shell configuration may be used for outside-the-waistband (OWB) carry, for example, and the second half-shell configuration may be used for concealed carry, such as inside-the-waistband (IWB), a concealed ankle holster, or the like, for the same handgun, using many of the same holster components. The holster can be converted back and forth between a full-shell holster and a half-shell holster whenever desired, in the field, by the user. In some embodiments, other configurations are also possible.

Figure 5:
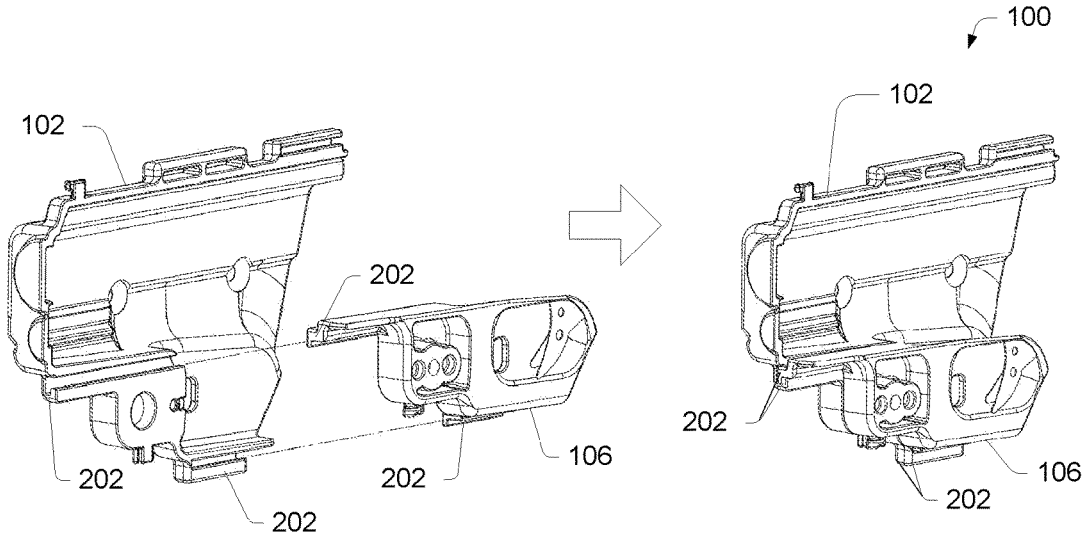
FIG. 5 shows an example illustration, from a side perspective, of joining two holster shell portions to form the example holster shell of FIG. 4, according to the second implementation.
Figure 6:
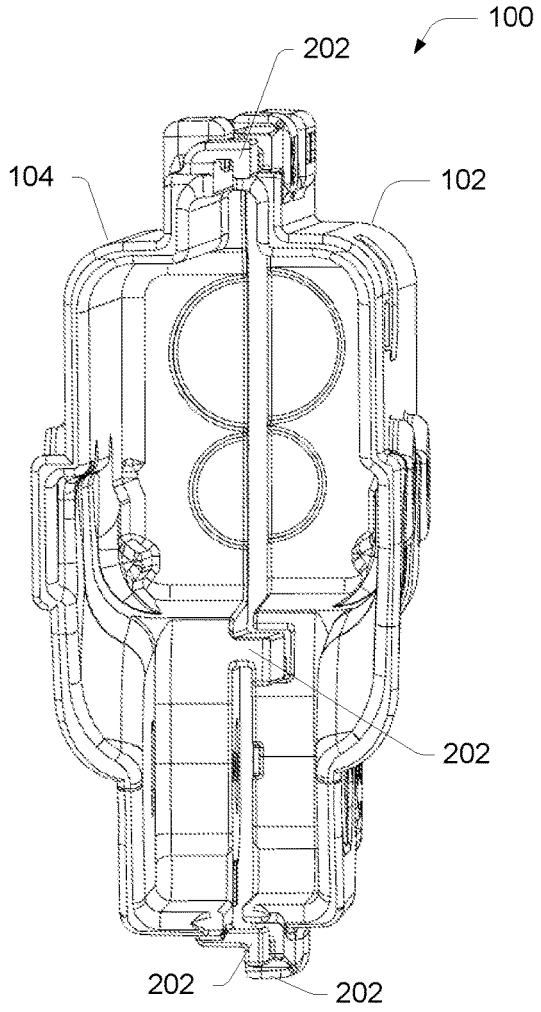
FIG. 6 shows an example illustration, from a front view, of joining two holster shell portions to form the example holster shell of FIG. 1, according to an implementation.
Figure 7:
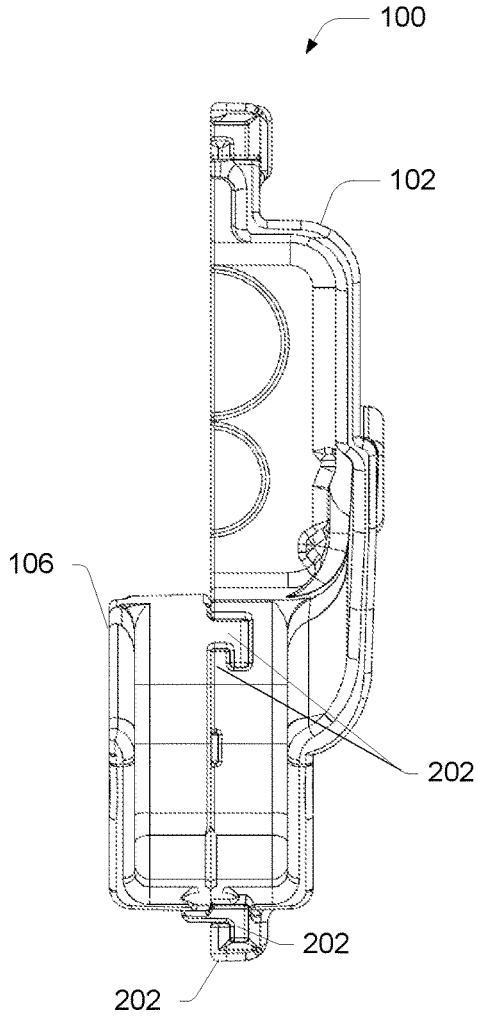
FIG. 7 shows an example illustration, from a front view, of joining two holster shell portions to form the example holster shell of FIG. 4, according to the second implementation.

As shown in the accompanying figures, the convertible holster system includes any of various techniques and methods comprising at least two major holster shell portions or halves (see FIG. 2, for example) that can be coupled together to form a holster in a first configuration as a full-shell holster (see FIG. 6, for example), and when desired, can be converted, using at least one of the holster shell portions or halves, to form a half-shell holster (see FIG. 7, for example) generally without the using the other holster shell half. In many embodiments, as shown in FIG. 5, the half-shell holster configuration can include a trigger guard cover shell portion for added safety. In many embodiments, when the trigger guard cover shell is used, it can be coupled to the half-shell in a similar way as the other half shell is coupled when forming the full shell holster. Alternate embodiments include coupling the trigger guard using a variety of other techniques.

As shown in FIGS. 1-21, the convertible holster system is convertible to the various configurations by a user in the field, based on easy to use couplers and locking mechanisms (used with holster shell portions), which are strong and secure enough to use with a handgun. This disclosure illustrates and describes many possible couplers and mechanisms in a number of example embodiments. The embodiments illustrated are not intended to be limiting, and other couplers and locking mechanisms may additionally or alternately be used with the holster shell portions of the convertible holster system and remain within the scope of the disclosure.

Techniques and devices are discussed herein with reference to example firearm holsters illustrated in the figures. However, this is not intended to be limiting, and is for ease of discussion and illustrative convenience. The techniques and devices discussed may be applied to any of various cases, case designs, combinations, and the like, (e.g., enclosures, sheaths, covers, cases, carriers, etc.) for encasing tools, weapons, or other implements and accessories, and remain within the scope of the disclosure. For the purposes of this disclosure, the use of the terms "carrier" or "holster" are interchangeable, and both terms apply equally to various holsters, carriers, covers, cases, enclosures, sheaths, etc. Further, the shape of the holsters and holster backers illustrated in the figures may vary to accommodate the various implements to be carried, as well as to accommodate various applications.

Implementations are explained in more detail below using a plurality of examples. Although various implementations and examples are discussed here and below, further implementations and examples may be possible by combining the features and elements of individual implementations and examples.

Example Embodiments

Figure 1:
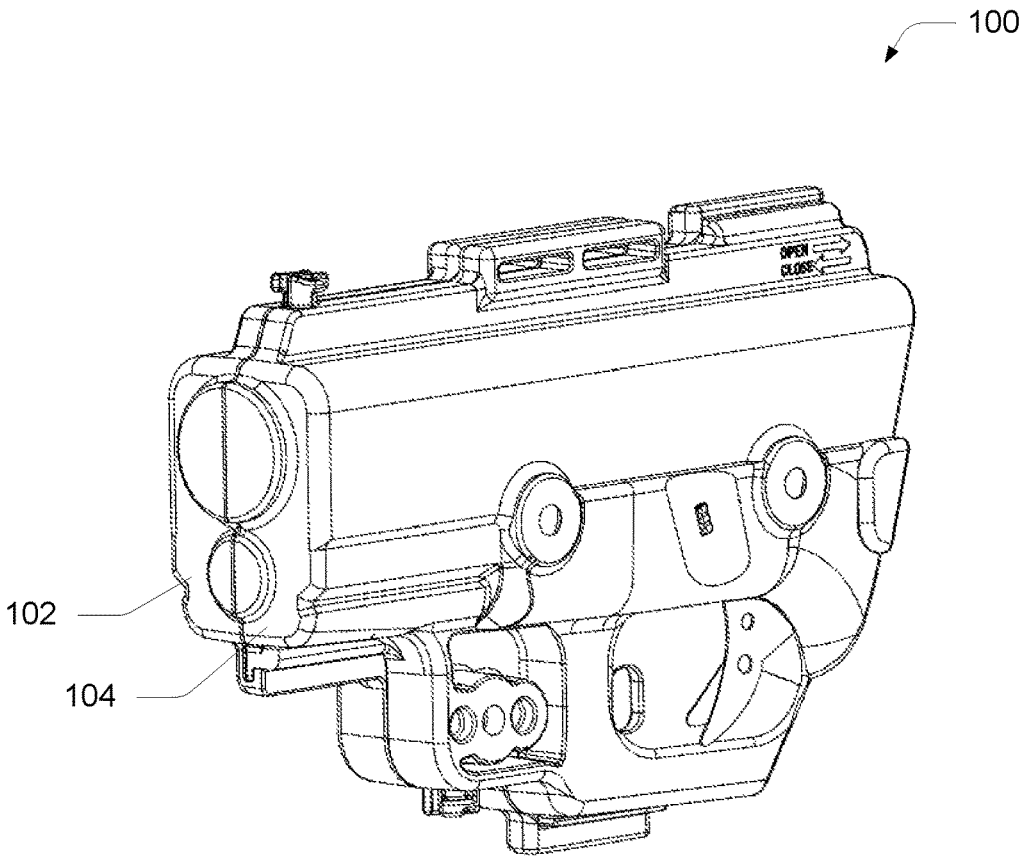
FIG. 1 shows a perspective view of an example adaptable holster shell, according to an implementation.

In an implementation, as shown in FIG. 1, a convertible holster 100 includes at least two holster portions (e.g., portions 102 and 104). In various implementations, the holster 100 may include three or more holster portions, and remain within the scope of the disclosure. Further, alternate or additional holster portions may supplement or be substituted for one or both of the holster portions 102 and 104, while performing an equivalent function (e.g., forming a holster 100 and encasing at least a portion of a holstered implement). In various embodiments, the shape and configuration of the holster portions 102 and 104 may vary to accommodate different implements (such as handguns, tools, or other implements). In an example, the holster portions 102 and 104 may be formed to closely fit a particular implement. In other examples, the holster portions 102 and 104 may be more generally formed to fit multiple implements.

Figure 2:
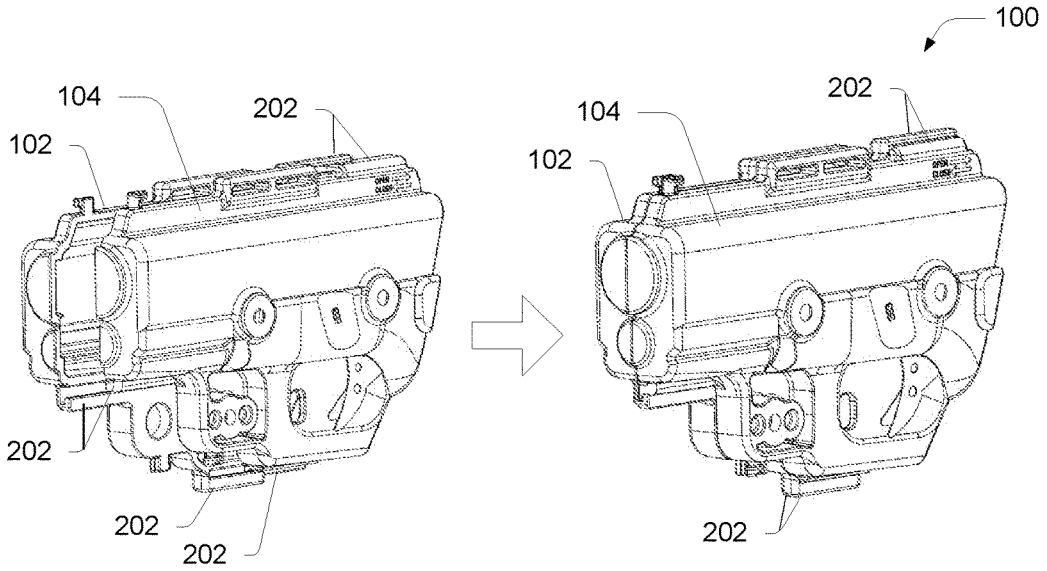
FIG. 2 shows an example illustration, from a front perspective, of joining two holster shell portions to form the example holster shell of FIG. 1, according to an implementation.
Figure 3:
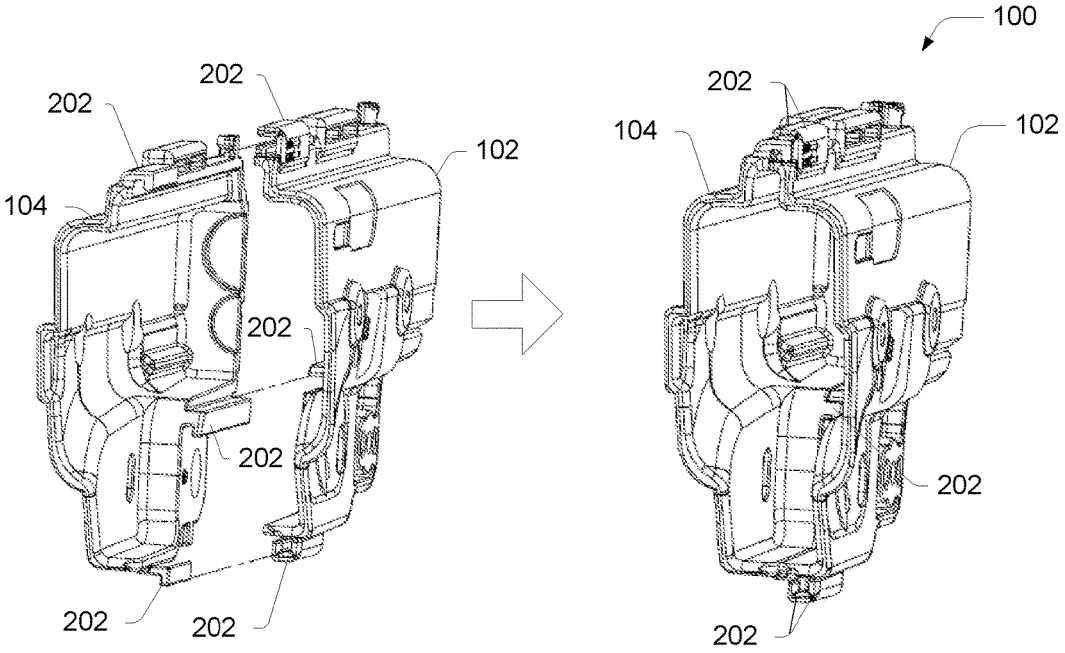
FIG. 3 shows an example illustration, from a back perspective, of joining two holster shell portions to form the example holster shell of FIG. 1, according to an implementation.

As shown in FIGS. 2 and 3, in a first configuration, the holster portions 102 and 104 comprise left and right half-shells that may be similar to each other or nearly a mirror image of each other. In this first configuration, the holster 100 comprises a full-shell holster 100, capable of encasing at least a portion of the holstered implement, and generally encasing a significant portion of the implement when it is holstered in the full-shell holster 100. For example, the full-shell holster 100 may be used with an OWB carry arrangement, or the like, and may be used with a paddle, with one or more clips, or the like, to be worn or carried on the user.

Figure 4:
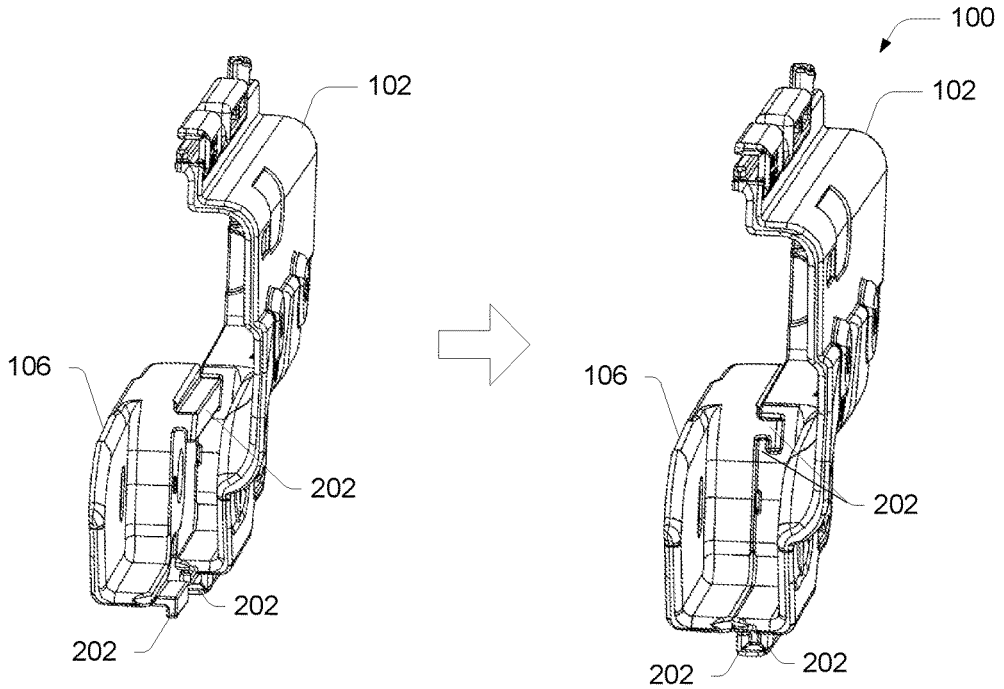
FIG. 4 shows an example illustration, from a back perspective, of joining two holster shell portions to form another example holster shell, according to a second implementation.

As shown in FIGS. 4 and 5, in a second configuration, the holster portion 102 can be coupled to a holster portion 106, instead of the holster portion 104. In the second configuration, the holster portion 102 comprises a half-shell, and the holster portion 106 comprises a fractional portion of a half-shell. For instance, the holster portion 106 may comprise a trigger guard portion, as illustrated in FIGS. 4 and 5, or the like. In this second configuration, the holster 100 comprises a half-shell holster 100, capable of encasing a portion of the holstered implement when it is holstered in the half-shell holster 100. For example, the half-shell holster 100 may be used with an IWB carry arrangement, an ankle-carry arrangement, or the like, and may be used with a backer, with one or more clips, or the like, to be worn or carried on the user.

In some alternate embodiments, the holster portion 102 may be used without the holster portion 104 or the holster portion 106 to form a half-shell holster 100. In these embodiments, the holster portion 102 may be used with a backer (see FIG. 18) or one or more other components to form the half-shell holster 100. In another alternate embodiment, the holster portion 102 may be used with one or more alternate shell portions (not shown) to form an alternate holster 100 configuration.

In an implementation, as shown in FIGS. 2-7, the holster system 100 is adaptable by making use of a sliding coupler system (one or more sliding couplers 202) that allows the holster portions 102 and 104 or holster portions 102 and 106 to slide together to become one holster 100 unit. FIGS. 2-7 illustrate various sliding couplers 202 on an example holster 100. In various embodiments, fewer or more sliding couplers 202 may be used. Sliding couplers 202 may have different interlocking shapes, but all allow mated sliding coupler 202 portions to engage each other by sliding one coupler 202 portion with respect to another coupler 202 portion, forming a secure coupler 202.

For instance, as shown in FIGS. 2-7, one holster portion 102 may be slid against another holster portion 104 or 106, while engaging the sliding couplers 202 on each portion 102 and 104 (first configuration) or 102 and 106 (second configuration), to couple the holster portions 102 and 104 or the holster portions 102 and 106 together. One or more detents, tabs, indicators, markings, or the like, may be formed into the holster portions 102 and/or 104 or 106, or the sliding couplers 202, to indicate that the holster portions 102 and 104 or the holster portions 102 and 106 are in position to form the holster 100. In some embodiments, the detents, tabs, indicators, markings, or the like, may give an audible, visual, or tactile feedback to indicate the completed coupling of the holster portions 102 and 104 or the holster portions 102 and 106. For example, arrows on a surface of each holster portion 102 and 104 or each holster portion 102 and 106 may line up, or the like, when the portions 102 and 104 or the portions 102 and 106 are fully coupled.

Referring to FIGS. 2-7, in various implementations, the holster 100 may be converted (in the field, by a user) from the first configuration to the second configuration by removing the holster portion 104 from the holster portion 102, by sliding the holster portion 104 away from the holster portion 102 using the sliding couplers 202 on the holster portion 104 and the holster portion 102. Then, the holster portion 106 may be coupled to the holster portion 102 by sliding the holster portion 106 against the holster portion 102 using one or more sliding couplers 202 on the holster portion 106 and the holster portion 102. In some embodiments, the holster portion 106 uses one or more of the same sliding couplers 202 on the holster portion 102 as does the holster portion 104.

Further, in the various implementations, the holster 100 may be converted (in the field, by a user) from the second configuration to the first configuration by removing the holster portion 106 from the holster portion 102, by sliding the holster portion 106 away from the holster portion 102 using the sliding couplers 202 on the holster portion 106 and the holster portion 102. Then, the holster portion 104 may be coupled to the holster portion 102 by sliding the holster portion 104 against the holster portion 102 using one or more sliding couplers 202 on the holster portion 104 and the holster portion 102.

In various alternate implementations, the holster 100 may make use of other mechanisms and/or techniques, as described below, to couple the holster portions 102 and 104 or 102 and 106 together. In the alternate implementations, the foregoing conversion processes (e.g., converting the holster 100 between the first and second configurations) incorporate the use of the other coupling mechanisms and/or techniques, rather than (or in addition to) using the sliding couplers 202.

As illustrated in FIGS. 8-12 and 16-21, in various embodiments, once coupled together, the holster portions 102 and 104 (or 102 and 106) may be locked into place for use using one or more locking mechanisms. In the embodiments, the locking mechanism(s) securely but temporarily lock the holster shell portions together, so that the holster portions stay coupled together until they are intentionally unlocked and separated (to convert the holster from one configuration to another).

Figure 8:
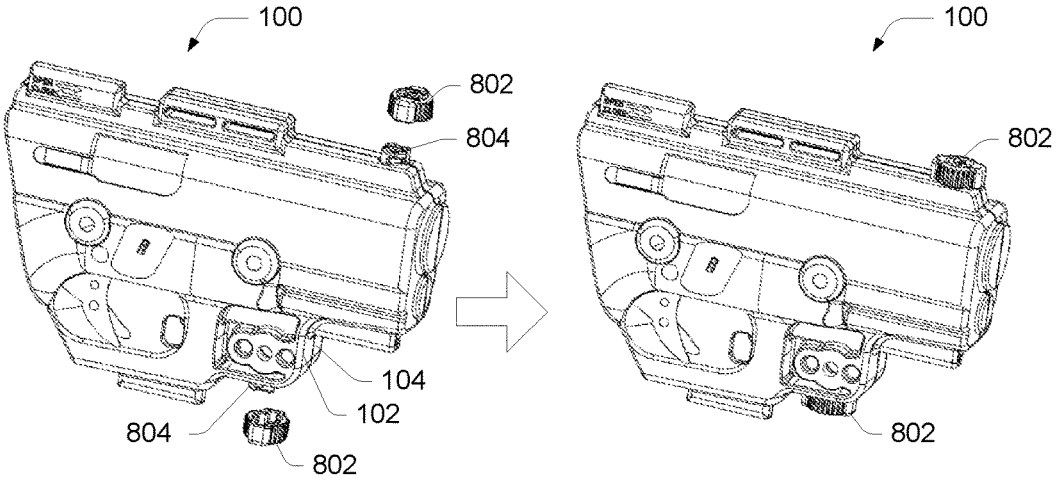
FIG. 8 shows an example illustration, from a side perspective, of using example lock components to lock two holster shell portions to form an example holster shell, according to an implementation.
Figure 9:
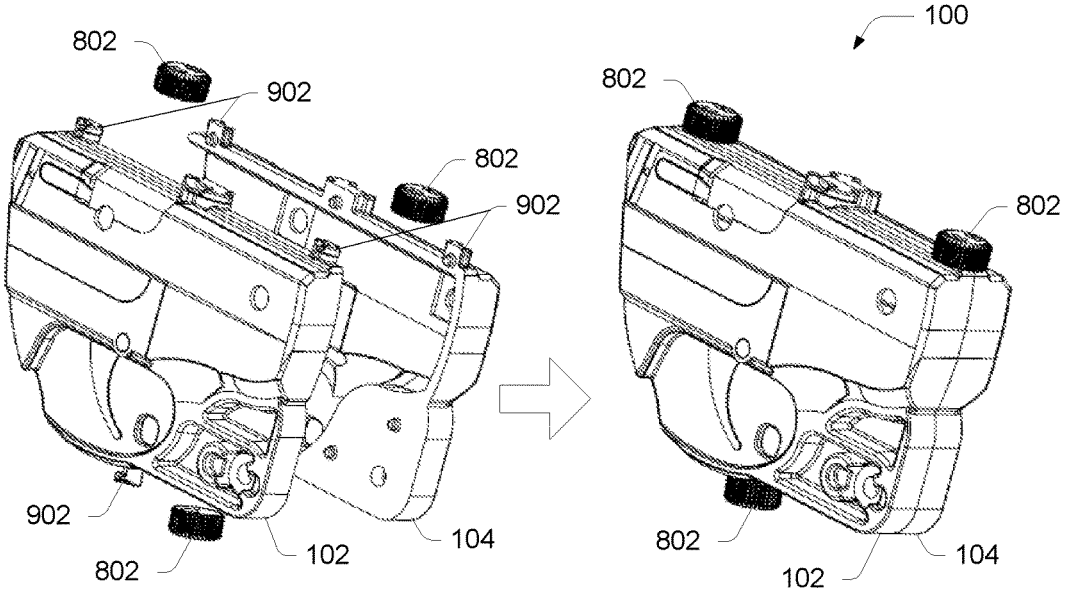
FIG. 9 shows an example illustration, from a side perspective, of using example lock components to lock two holster shell portions to form another example holster shell, according to another implementation.

In an embodiment, as shown in the example of FIGS. 8 and 9, an example locking mechanism comprises a twist lock device 802. In other embodiments, the locking mechanism may include any of various devices that prevent the holster portions (102 and 104 or 102 and 106) or holster components or sliding couplers 202 (if present) from sliding or moving with respect to each other.

In various implementations, as shown in FIGS. 8 and 9, the twist lock device 802 comprises a cap, ring, or the like, that is twisted onto a boss component 804 disposed on one or more of the holster portions 102, 104, and/or 106. For example, the boss 804 may be threaded or otherwise formed to accept the twist lock device 802.

In some embodiments, as illustrated in FIG. 9, the boss 804 is formed when joining the two holster portions 102 and 104 or 102 and 106. For example, each of the holster portions 102 and 104 or 102 and 106 may include a part 902 of the boss 804, so that the boss 804 is formed when the holster portions 102 and 104 or 102 and 106 are joined (thereby joining the parts 902). The twist lock device 802 holds the boss parts 902 together and holds the holster portions 102 and 104 or 102 and 106 in the joined arrangement, preventing the holster portions 102 and 104 or 102 and 106 or the sliding couplers 202 (if present) from sliding or otherwise moving with respect to each other.

To separate the holster portions 102 and 104 or 102 and 106, the lock device 802 is intentionally removed, and the holster portions 102 and 104 or 102 and 106 can be separated.

Additional Example Embodiments

FIGS. 10-21 show additional example convertible holsters 100, according to additional embodiments. In some examples, the holster shell portions 102 and 104 or 102 and 106 may be joined by sliding the holster portions 102 and 104 or 102 and 106 together (using sliding couplers 202, or the like, for instance). Additionally or alternatively, the holster portions 102 and 104 or 102 and 106 may be joined using other mechanisms, techniques, and/or couplers. In some embodiments, the holster portions 102 and 104 or 102 and 106 are held in place with locking mechanisms (such as the twist lock device 802, or the like). The locking mechanisms illustrated and described with respect to FIGS. 8-21 are examples, and not intended to be limiting.

Figure 10:
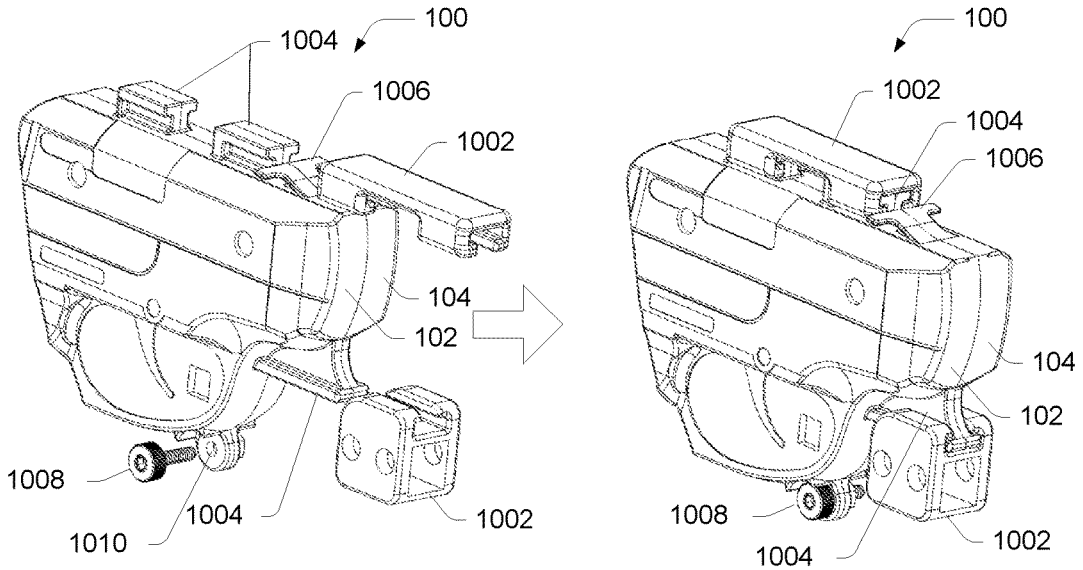
FIG. 10 shows an example illustration, from a side perspective, of using example lock components to lock two holster shell portions to form a further example holster shell, according to a further implementation.
Figure 11:
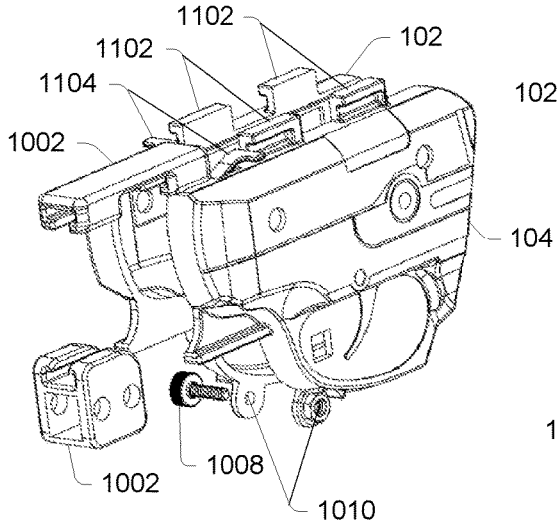
FIG. 11 shows an example illustration, from a front perspective; of two holster portions and example lock components which may be joined to form an example holster shell, according to an implementation.
Figure 12:
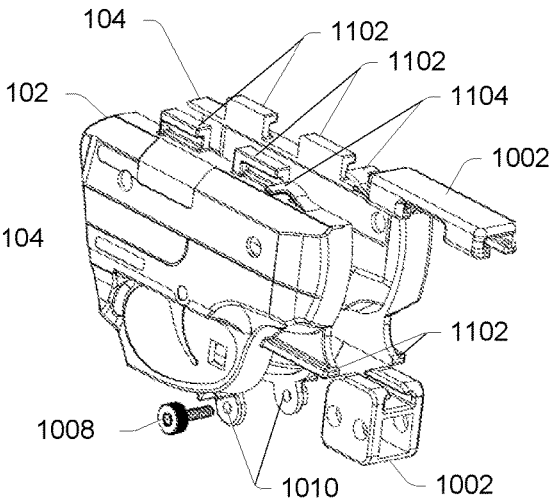
FIG. 12 shows an example illustration, from a front perspective; of two holster portions and example lock components which may be joined to form an example holster shell, according to an implementation.

In an implementation, as shown at FIGS. 10-12, the holster 100 may be coupled together using one or more exterior slide lock devices 1002. For instance, as shown in FIGS. 10-12, the slide lock(s) 1002 may be slid over one or more exterior rails 1004 (or the like) integral to the holster portions 102, 104, or 106, to lock the holster portions 102 and 104 or 102 and 106 together. In various embodiments, the rails 1004 may have any profile shape that is convenient, with a complementary shape found on the slide lock devices 1002.

In some embodiments, as illustrated in FIGS. 11 and 12, the rails 1004 may be formed when joining the two holster portions 102 and 104 or 102 and 106. For example, each of the holster portions 102 and 104 or 102 and 106 may include a part 1102 of the rail 1004, so that the rail 1004 is formed when the holster portions 102 and 104 or 102 and 106 are joined (thereby joining the parts 1102). The slide lock device 1002 holds the rail parts 1102 together and holds the holster portions 102 and 104 or 102 and 106 in the joined arrangement, preventing the holster portions 102 and 104 or 102 and 106 from moving with respect to each other.

In an embodiment, as shown at FIGS. 10-12, the slide lock 1002 may be held in place with a lock tab 1006, or the like. For instance, the slide lock 1002 may compress the lock tab 1006 when sliding over the rail 1004, allowing the lock tab 1006 to expand when the slide lock 1002 has moved past the lock tab 1006. In the expanded position, the lock tab 1006 holds the slide lock 1002 in place, until intentionally compressed by the user. Compressing the lock tab 1006 allows the slide lock 1002 to slide off of the rail(s) 1004 for disassembling the holster 100.

In another implementation, as also shown at FIGS. 10-12, the holster 100 may be coupled together using one or more thumb screw devices 1008. For instance, as shown in FIGS. 10-12, the thumb screw(s) 1008 may be inserted into one or more openings 1010 (or the like) integral to the holster portions 102, 104, and 106, to lock the holster portions 102 and 104 or 102 and 106 together. In various embodiments, the openings 1010 may be threaded, or include fasteners, such as nuts, or the like.

Figure 13:
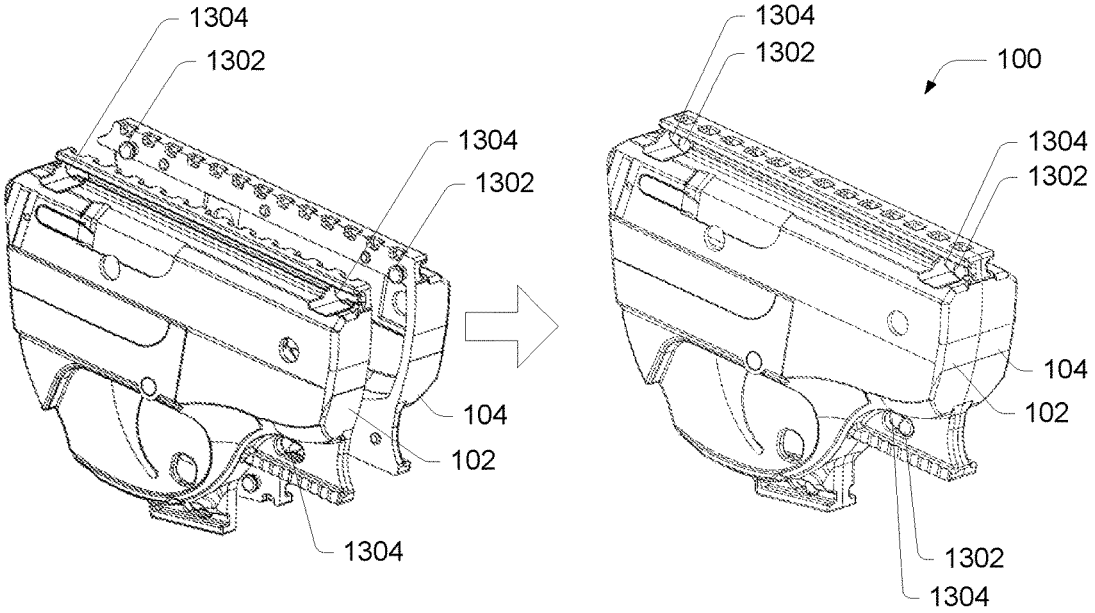
FIG. 13 shows an example illustration, from a side perspective, of joining two holster shell portions to form an example holster shell, according to an implementation.
Figure 14:
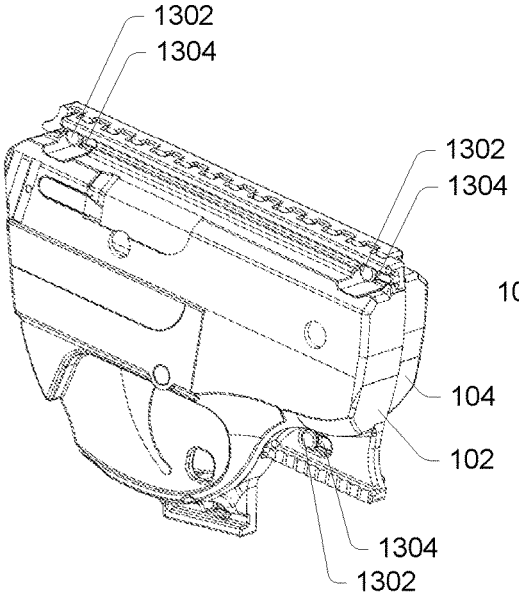
FIGS. 14 and 15 show example illustrations, from a front perspective; of two holster portions which may be joined to form the example holster shell of FIG. 13, according to an implementation.
Figure 15:
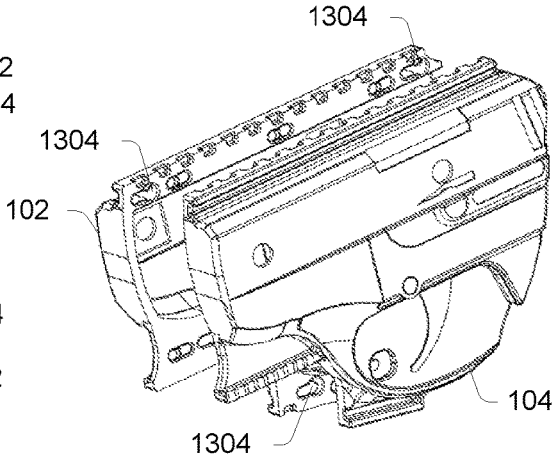

As shown in FIGS. 13-15, key mod attachments may be used to couple the holster portions 102, 104, 106 together. A key post 1302 on one holster portion (e.g., 104 or 106) is inserted into a key slot 1304 on the other holster portion (e.g., 102) at each key mod attachment location. The holster shell portions are slid to lock the key post 1302 into the key slot 1304. The key slot 1304 may be keyhole shaped to allow the post 1302 to be inserted into the slot 1304, and to trap the post 1302 in the slot 1304 when the holster portions 102, 104, or 106 are slid together. The holster portions 102 and 104 or 106 are slid in a reverse direction to remove the post 1302 from the slot 1304 and to separate the holster portions 102 and 104 or 106. In some implementations, locking fasteners, or the like, may also be used to secure the holster portions 102 and 104 or 106 together, and to prevent them from sliding with respect to each other unintentionally. The locking fasteners are removed prior to intentionally separating the holster portions 102 and 104 or 106.

In other embodiments, locking bumps, or the like may be used with the implementations described with reference to FIGS. 13-15, for instance, or with other implementations. For example, one or more locking bumps may be disposed on an interior surface of a holster portion 102, 104, or 106. The locking bumps may be used with depressions, recesses, holes, or the like, disposed at the other holster portion 102, 104, or 106, where the bumps engage the recesses when the holster portions 102 and 104 or 106 are slid, and the post(s) are trapped in the slot(s). The bumps can provide a secure engagement of the holster portions 102 and 104 or 106 in the coupled position, holding the holster portions 102 and 104 or 106 in the coupled position until intentionally separated.

Figure 16:
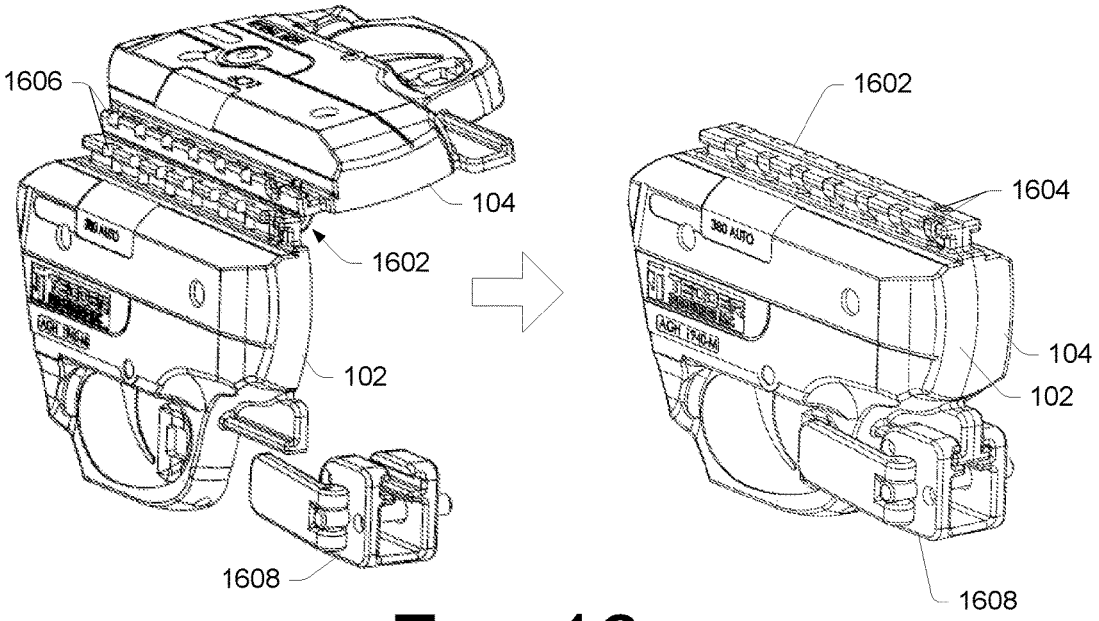
FIG. 16 shows an example illustration, from a front perspective, of using example shell portions and lock components to form an example holster shell, according to an implementation.
Figure 17:
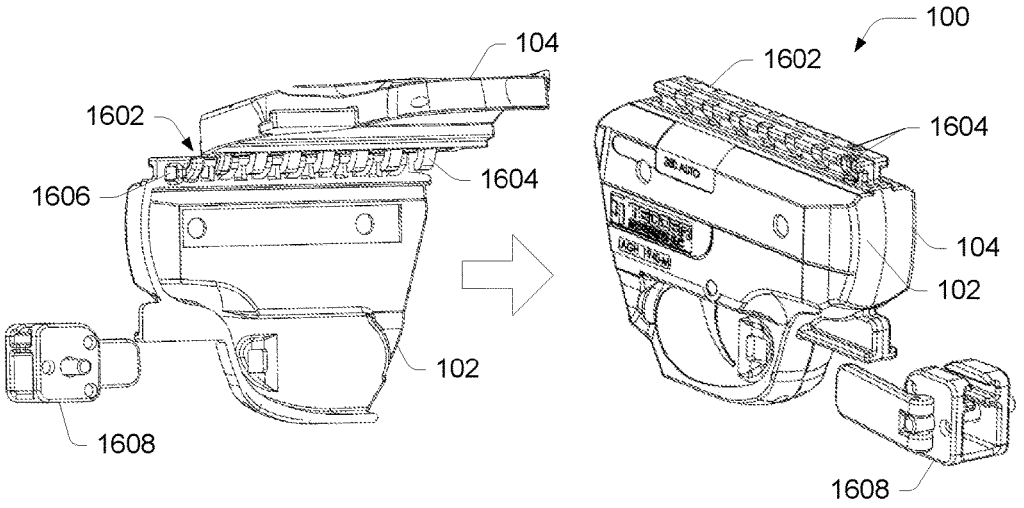
FIG. 17 shows an example illustration, from a side perspective, of using the example shell portions and lock components to form the example holster shell of FIG. 16, according to the implementation.

As shown in FIGS. 16 and 17, a hinge-type coupler 1602 can be used to couple the holster portions 102 and 104 or 106 to form a holster 100. Teeth 1604 on one (or both) of holster portions 102 and 104 or 106 engage with openings 1606 on the other (or both) of the holster portions 102 and 104 or 106 to form the hinge-type coupler 1602. In an embodiment, as shown in FIGS. 16 and 17, the hinge coupler 1602 can form a rail (for accessories, etc.) when the holster portions 102 and 104 or 106 are joined together. Further, a locking mechanism 1608 can be used in some embodiments to keep the holster portions 102 and 104 or 106 in coupled position, as shown. In the embodiment illustrated, the locking mechanism 1608 slides onto a rail formed by the holster portions 102 and 104 or 106, and locks in place using a cam-style clamp. In alternate implementations, other locking mechanisms may also be used, having different designs.

Figure 18:
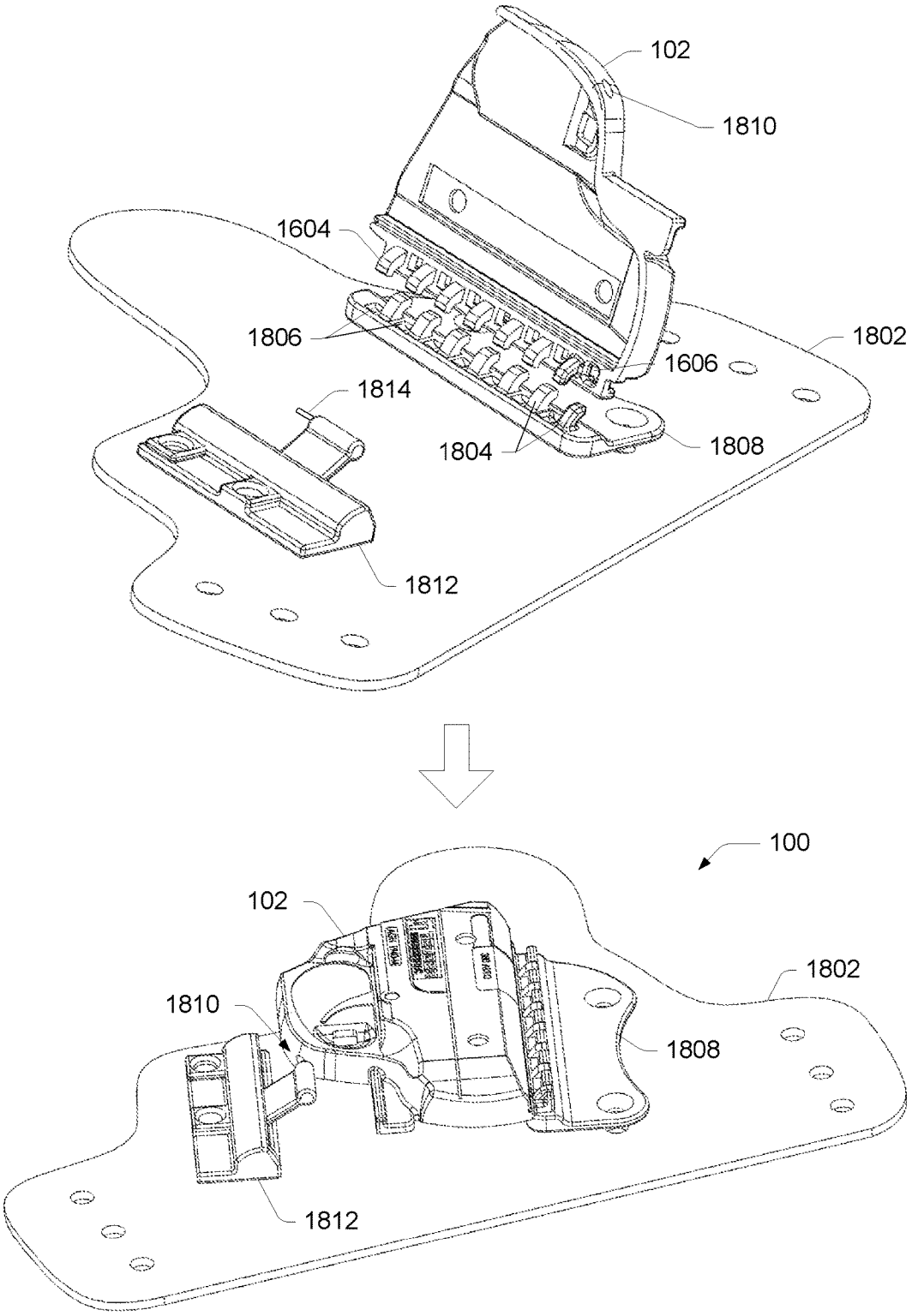
FIGS. 18-21 show illustrations, from a perspective view, of using example shell portions and lock components to form example holsters, according to some implementations.

FIG. 18 shows an example of forming a half-shell holster (a second configuration) from the full-shell holster 100 (a first configuration) of FIG. 16, having the hinge-type coupler 1602. If coupled together, as shown in FIG. 16, the holster portions 102 and 104 can be separated by removing the locking mechanism 1608 (if present), and removing the teeth 1604 from the openings 1606 of the hinge coupler 1602.

One of the holster portions 102 or 104 can be coupled to a backer 1802, for instance, as shown in FIG. 18, (or to a clip, a belt, a pocket, a carrier, etc.) to form the half-shell holster 100 configuration. In the example of FIG. 18, the teeth 1604 on the holster portion 102 can be engaged with holes 1806 in an attachment device 1808 fastened to the holster backer 1802. The teeth 1804 of the attachment device 1808 are inserted into (and engaged with) the holes 1606 in the holster portion 102. This couples the holster portion 102 to the attachment device 1808 and the backer 1802.

The holster portion 102 can be secured to the backer 1802 using various techniques and/or devices. In an example, as shown in FIG. 18, an opening 1810 in the holster portion 102 can provide a mounting point for a clamp device 1812 fastened to the backer 1802. In this example, the clamp device 1812 includes a pin 1814 that is inserted into the opening 1810 in the holster portion 102. In other examples, other clamps, fasteners, attachments, etc. can be used to secure the holster portion 102 to the backer 1802.

Figure 19:
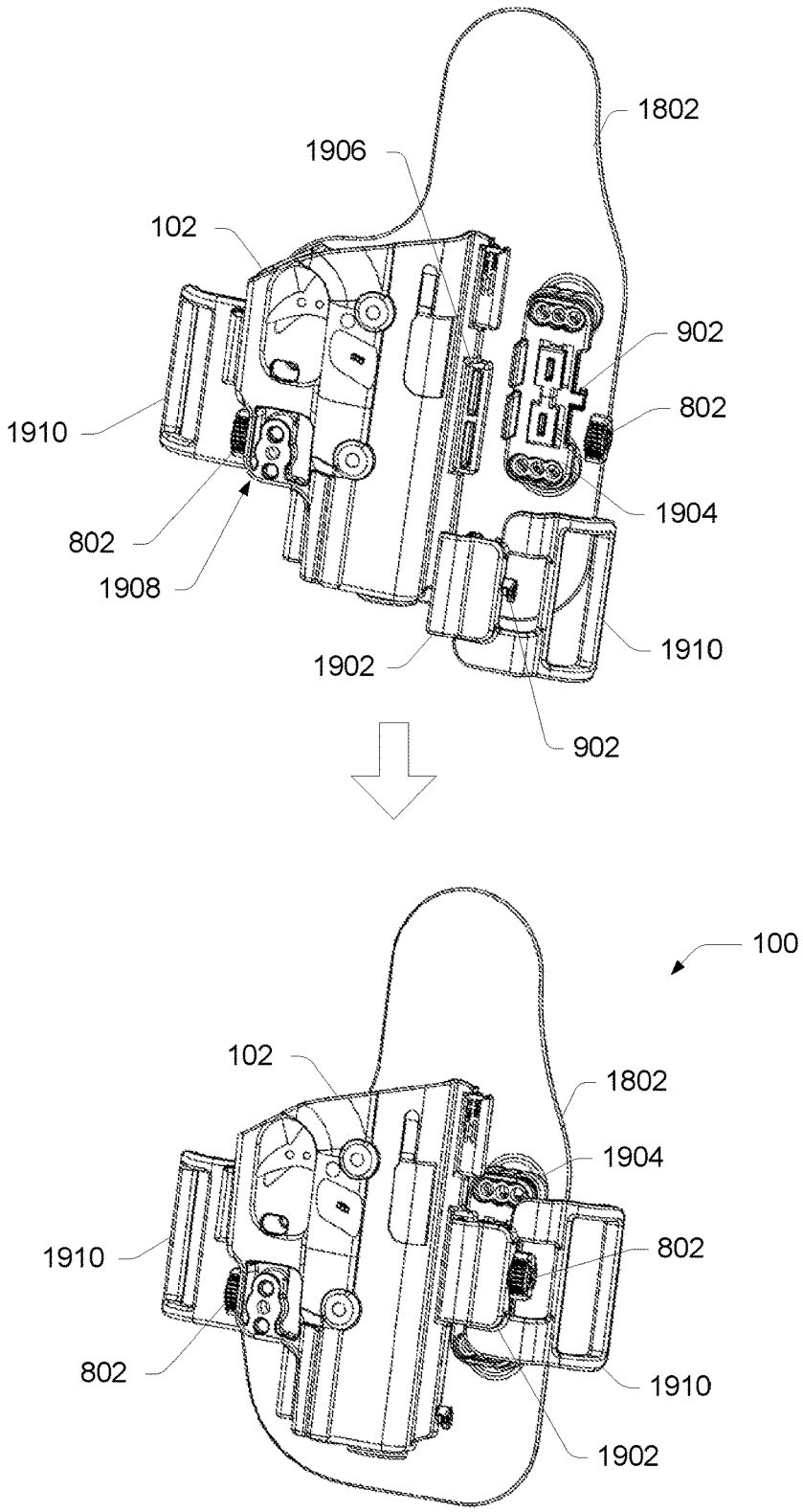
Figure 20:
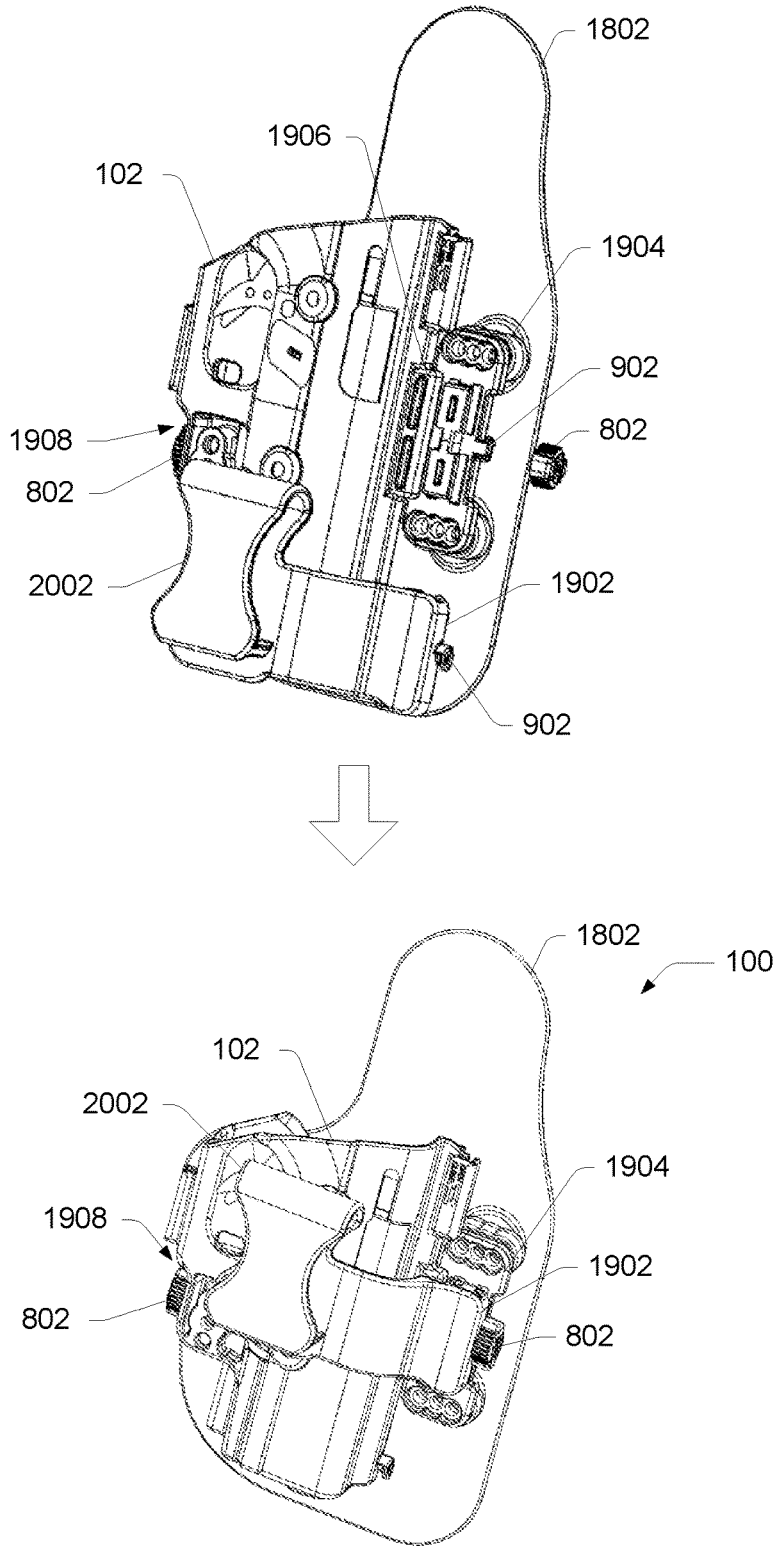
Figure 21:
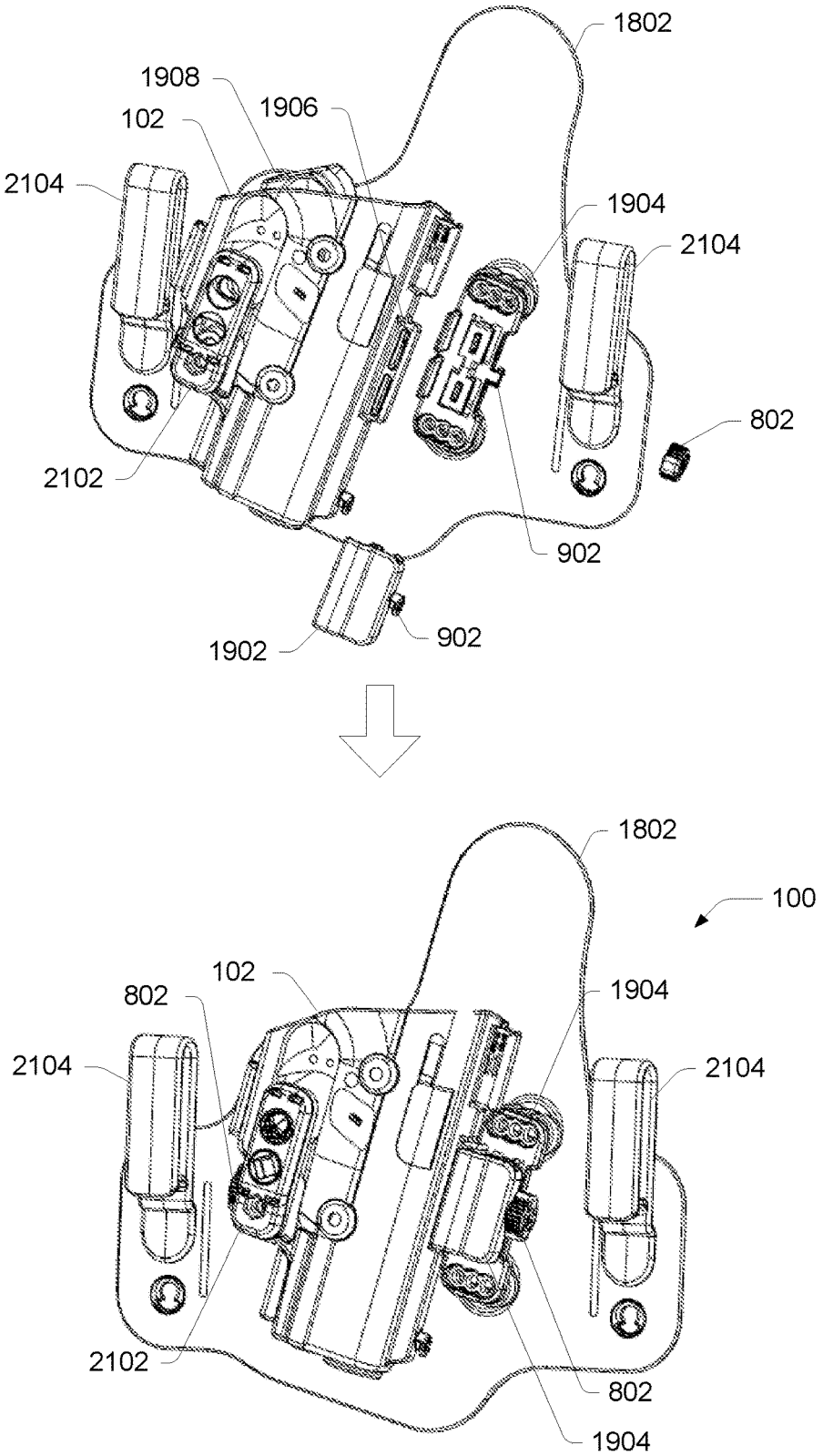

For example, FIGS. 19-21 also show examples of forming a half-shell holster 100 (a second configuration) from a holster portion 102 (which may be part of a full-shell holster, e.g., a first configuration) using a twist lock device 802. If coupled together, (as shown in FIG. 8), the holster portions 102 and 104 can be separated by removing the twist lock device 802 (if present).

One of the holster portions (e.g., holster portion 102) can be coupled to a backer 1802, for instance, as shown in FIGS. 19-21, (or to a clip, a belt, a pocket, a carrier, etc.) to form the half-shell holster 100 (second configuration). In the examples of FIGS. 19-21, the holster portion 102 is coupled to the backer 1802 using a first coupler 1902 which fits over a second attachment device 1904, which is attached to the backer 1802. The holster portion 102 includes one or more coupler features 1906 (e.g., a slotted coupler, various openings, or the like) that interface with complementary features (e.g., tabs, pins, hooks, etc.) of the coupler 1902 and/or the attachment device 1904, to position the holster portion 102 on the backer 1802. The coupler 1902 is fitted over the attachment device 1904, and may be locked with the twist lock device 802, or another secure and removable locking mechanism. For example, the coupler 1902 and the attachment device 1904 may each have a boss part 902, which forms a boss 804 when joined. The twist lock device 802 fits over the boss 804 and holds the boss parts 902 together, trapping the coupler feature(s) 1906 between the coupler 1902 and the attachment device 1904. This couples the holster portion 102 to the attachment device 1904 and the backer 1802.

As shown in FIGS. 19-21, a similar arrangement may be present at one or more other locations on the backer 1802 to further couple the holster portion 102 to the backer 1802. For instance, an attachment device 1908 may be attached to the backer 1802 at the one or more other locations, which can be used to lock the holster portion 102 (via a feature, a boss 804, a boss part 902, a locking component 2102, etc., on or coupled to the holster portion 102) to the backer 1802.

As shown in FIGS. 19-21, a twist lock device 802 (or other locking mechanism) can be used to secure the holster portion 102 to the attachment device 1908, and thus, the backer 1802. In other examples, other clamps, fasteners, attachments, etc. can be used to secure the holster portion 102 to the backer 1802.

As shown in FIGS. 19 and 20, one or more belt slides 1910 or belt clips 2002 can be coupled to the backer 1802 via the coupler 1902, the attachment device 1904, the attachment device 1908, or the like, for convenience in wearing the holster 100. In some implementations, the belt slide(s) 1910 or belt clip(s) 2002 are integral to at least one of the coupler 1902, the attachment device 1904, and/or the attachment device 1908. Alternately, as shown in FIG. 21, belt attachments 2104 (such as clips, hooks, slides, etc.) may be directly coupled to the backer 1802.

In alternate embodiments, a trigger guard cover (such as holster portion 106), or the like, can also be attached to the holster portion 102 to form the half-shell holster 100 with the backer 1802.

In the various example embodiments illustrated in FIGS. 1-21, the location and position of the attachment devices, locking mechanisms, and the like are for example only. Other locations and positions are contemplated and are within the scope of this disclosure.

In various implementations, components of the convertible holster 100 are comprised of various plastics, composites, metals, combinations of the same, or the like. For example, the holster portion 102, the holster portion 104, and/or the holster portion 106 may be comprised of a polyamide, or similar material. For example, the holster portions 102, 104, and/or 106 may be injection molded, stamped, formed, or the like. In various embodiments, the holster portions 102, 104, and 106 have rigidity and stability properties based on a particular material selected for the holster portions 102, 104, and 106. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the holster portions 102, 104, and 106.

The illustrations of FIGS. 1-21 are not intended to be limiting. While a handgun holster is illustrated, various other types of implement holsters, cases, carriers, and the like are also within the scope of the disclosure. Further, the design of the holster as well as the design of the various attachment devices may vary. Other attachment devices and techniques are also within the scope of the disclosure.

Various implementations and examples are discussed herein, and further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the disclosed techniques, systems, and devices. Further, individual features of various embodiments may be combined to form other embodiments not specifically described.

What is claimed is:

1. A convertible holster system for an implement, comprising:

a first holster portion arranged to enclose a first portion of an implement;

a second holster portion arranged to be coupled to the first holster portion and to enclose a second portion of the implement;

a third holster portion arranged to be coupled to the first holster portion and to enclose a third portion of the implement, the third portion of the implement comprising a fraction of the second portion of the implement; and one or more couplers arranged to couple the second holster portion to the first holster portion to form a first holster for the implement in a first configuration and arranged to couple the third holster portion to the first holster portion to form a second holster for the implement in a second configuration.

2. The convertible holster system of claim 1, further comprising one or more locking components arranged to temporarily lock the second holster portion to the first holster portion and to temporarily lock the third holster portion to the first holster portion.

3. The convertible holster system of claim 2, wherein the one or more locking components comprise a twist lock device arranged to be twisted onto a portion of the first holster or the second holster.

4. The convertible holster system of claim 2, further comprising one or more bosses arranged to engage the one or more locking components, wherein portions of the one or more bosses are integral to the first holster portion, the second holster portion, and the third holster portion, the portions of the one or more bosses forming the one or more bosses when the second holster portion is coupled to the first holster portion or when the third holster portion is coupled to the first holster portion.

5. The convertible holster system of claim 1, further comprising one or more slide lock devices arranged to slide over an integral feature of the first holster or the second holster to lock the second holster portion to the first holster portion or to lock the third holster portion to the first holster portion.

6. The convertible holster system of claim 1, further comprising a backer arranged to be coupled to the first holster portion and to enclose the second portion of the implement, the backer and the first holster portion arranged to form a third holster for the implement in a third configuration when coupled together.

7. The convertible holster system of claim 6, further comprising one or more attachment devices coupled to the backer and arranged to couple the first holster portion to the backer using the one or more couplers.

8. The convertible holster system of claim 1, wherein the first holster portion comprises a first hard shell component formed to resemble the first portion of the implement, the second holster portion comprises a second hard shell component formed to resemble the second portion of the implement, and the third holster portion comprises a third hard shell component formed to resemble the fraction of the second portion of the implement.

9. The convertible holster system of claim 8, wherein the second hard shell component comprises a substantial mirror image of the first hard shell component.

10. The convertible holster system of claim 1, wherein one or more of the couplers is integral to one or more of the first holster portion, the second holster portion, and the third holster portion.

11. The convertible holster system of claim 1, wherein the one or more couplers comprise sliding couplers integral to the first holster portion, the second holster portion, and the third holster portion, the sliding couplers having interlocking shapes arranged to engage and to couple the second holster portion to the first holster portion when the second holster portion is slid against the first holster portion and to couple the third holster portion to the first holster portion when the third holster portion is slid against the first holster portion.

12. A holster for an implement, comprising:

a first shell portion;

a second shell portion arranged to be coupled to the first shell portion to form a holster enclosure having a first configuration by sliding the first shell portion with respect to the second shell portion;

one or more sliding couplers arranged to engage and secure the first shell portion to the second shell portion when the first shell portion is slid with respect to the second shell portion, the one or more sliding couplers including a first coupler portion integral to the first shell portion and a second coupler portion integral to the second shell portion; and one or more locking mechanisms arranged to prevent the first coupler portion of the one or more sliding couplers from unintentionally sliding with respect to the second coupler portion of the one or more sliding couplers; a third shell portion arranged to be coupled to the first or second shell portion via the sliding couplers and locking mechanisms on the first or second shell portion and mating sliding couplers on the third shell portion to form a holster enclosure having a second configuration, wherein one of the first and second configurations comprises a full-shell holster for the implement and the other of the first and second configurations comprises a half-shell holster for the implement.

13. A convertible holster system for a firearm, comprising:

a first hard shell portion formed to resemble a first portion of the firearm; and a second hard shell portion formed to resemble a second portion of the firearm, wherein the first shell portion forms a half-shell holster in a first configuration, the half-shell holster arranged to encase the first portion of the firearm and to support the firearm without the second shell portion, and wherein the second shell portion is arranged to be coupled to the first shell portion to form a full-shell holster in a second configuration, the full-shell holster arranged to encase the first portion and the second portion of the firearm a trigger guard cover shell portion arranged to be coupled to the first shell portion, the first shell portion and the trigger guard cover shell portion forming the half-shell holster of the first configuration, and arranged to encase the first portion and a third portion of the firearm and to support the firearm without the second shell portion.

14. The holster system of claim 13, further comprising one or more couplers arranged to engage and to couple the first shell portion to the second shell portion when the first shell portion is moved with respect to the second shell portion, the one or more couplers including a first coupler portion integral to the first shell portion and a second coupler portion integral to the second shell portion.

15. The holster system of claim 13, further comprising one or more locking mechanisms arranged to prevent the first shell portion from unintentionally separating from the second shell portion when the first shell portion and the second shell portion are coupled together in the second configuration.

16. The holster system of claim 13, further comprising a backer arranged to be coupled to the first shell portion, the first shell portion and the backer arranged to form the half-shell holster in the first configuration and to encase the first portion and the second portion of the firearm.

* * * * *